US006822567B2

(12) United States Patent
Durbin

(10) Patent No.: US 6,822,567 B2
(45) Date of Patent: Nov. 23, 2004

(54) SECURITY DEVICE FOR A BOTTLE

(75) Inventor: Paul Francis Durbin, Hertford (GB)

(73) Assignee: Plescon Limited (GB)

( * ) Notice: Subject to any disclaimer, the term of this patent is extended or adjusted under 35 U.S.C. 154(b) by 8 days.

(21) Appl. No.: 10/240,584

(22) PCT Filed: Mar. 30, 2001

(86) PCT No.: PCT/GB01/01399

§ 371 (c)(1),
(2), (4) Date: Oct. 1, 2002

(87) PCT Pub. No.: WO01/75254

PCT Pub. Date: Oct. 11, 2001

(65) Prior Publication Data

US 2003/0047530 A1 Mar. 13, 2003

(30) Foreign Application Priority Data

Apr. 1, 2000 (GB) ..... 0007985

(51) Int. Cl.[7] ..... G08B 13/14
(52) U.S. Cl. ..... 340/568.1; 215/201
(58) Field of Search ..... 340/568.1, 540; 215/201, 207; 24/704.1

(56) References Cited

U.S. PATENT DOCUMENTS 5,602,530 A * 2/1997 Holmgren ..... 340/572.1
6,098,256 A 8/2000 Poussard ..... 24/704.1

FOREIGN PATENT DOCUMENTS

EP 0915222 5/1999 ..... B65D/23/12
FR 2704592 11/1994 ..... E05B/73/00

OTHER PUBLICATIONS

International Search Report, International Application No. PCT/GB01/01399. Date: Jul. 18, 2001.

* cited by examiner

*Primary Examiner*—Jeffery Hofsass
*Assistant Examiner*—Jennifer Stone
(74) *Attorney, Agent, or Firm*—Jansson, Shupe & Munger, Ltd.

(57) ABSTRACT

A security device for a bottle having a neck fitted with a closure comprises a sleeve adapted to fit over the neck of the bottle and a catch member pivoted to the sleeve for movement between free and locking positions. The catch member has an inner portion which projects through an aperture in the sleeve, into the bore thereof, which inner portion is adapted to engage a shoulder of the bottle neck or an edge of the closure, thereby to resist removal of the sleeve from a bottle neck when the device has been fitted thereto. A magnetic armature is connected to the catch member such that an applied magnetic field will move the armature so as then to move the catch member to its free position and thereafter permit removal of the sleeve from the bottle. A housing encloses the release mechanism and also a radio-frequency or other security responder whereby unauthorized removal of a bottle carrying the security device from a protected area will sound an alarm.

20 Claims, 5 Drawing Sheets

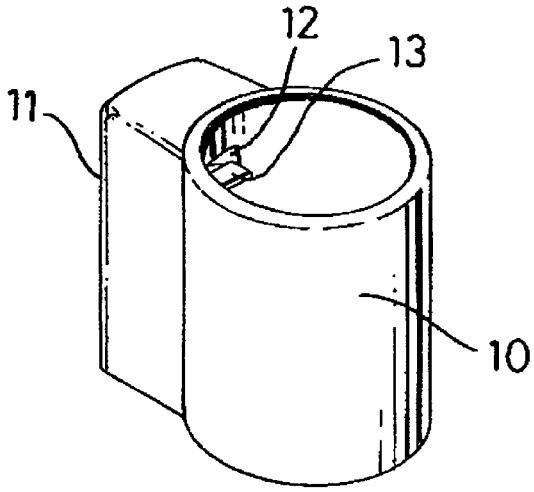
FIG.1
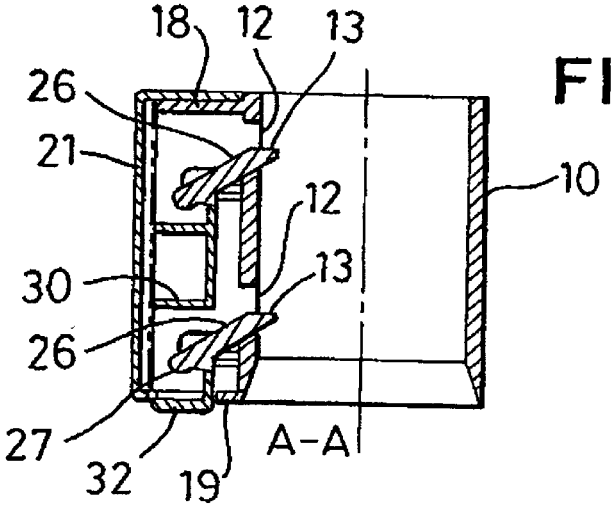
FIG.2
FIG.3
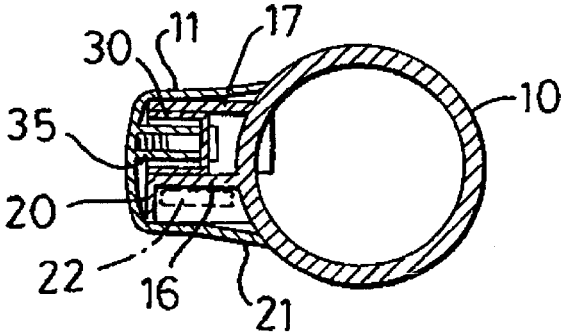

SECURITY DEVICE FOR A BOTTLE

FIELD OF THE INVENTION

This invention relates to a security device for a bottle—that is to say, a device which may be secured to a bottle and which may serve to reduce the likelihood of misappropriation of the bottle, for example from a shop or store.

BACKGROUND OF THE INVENTION

Theft of various products from shops is an ever increasing problem, especially with self-selection stores. In an attempt to address this problem, it is now a common practice to attach a security label to the products on offer, even for products not having an especially high value, which security label is adapted and configured to trigger an alarm mechanism should the product carrying the label be taken out of the store before the label has been disabled in some way, or otherwise removed from the product.

With many products, label-based security systems work well but an important aspect of security systems of this kind is that the system should be highly visible, so as to act as a deterrent against theft. On the other hand, the label should not damage the product, or otherwise make the product less attractive to a purchaser. In view of this, some security systems utilise a device which is intended only for temporary attachment to a product so long as the product remains in the shop—for example, in the case of clothing. At the time of purchase of the product, the security device is removed from the product so that the product may be carried out of the store without evidence of the previous presence of the security device attached to the product.

A particular problem arises in the case of high-value bottles of drink, such as spirits, champagnes and vintage wines. The only way in which a label can be attached to a glass bottle is by means of an adhesive, but the use of such a label detracts from the aesthetic qualities of the product. Moreover, if the label has sufficiently strong adhesive to prevent it being removed in an unauthorised way by an intending thief, a purchaser cannot subsequently easily remove the label, for example if the product is purchased as a gift for a third party.

It is a principal aim of the present invention to address the above problem by providing a security device which may be temporarily attached to a wide range of bottles and resist unauthorised removal, and yet which may be removed relatively easily, leaving the bottle unmarked, by an authorised person.

BRIEF SUMMARY OF THE INVENTION

According to the present invention, there is consequently provided a security device for a bottle having a neck fitted with a closure, comprising a sleeve adapted to fit over the neck of the bottle, a catch member movable between free and locking positions, the catch member having an inner portion which projects through an aperture in the sleeve into the bore thereof and which inner portion is adapted to engage a shoulder of the bottle neck or the closure thereby to resist removal of the sleeve from a received bottle neck when the catch member is in its locking position, magnetically-operable release means operatively associated with the catch member to control movement thereof to its free position when subjected to an external magnetic field, and a housing enclosing the release means and that part of the catch member external of the sleeve to prevent manual access thereto.

The security device of this invention is adapted to fit over the neck of a bottle and, when positioned there, is automatically retained on the neck until such time as it is removed by an authorised person having an appropriate magnetic release tool. Should an unauthorised attempt be made to remove the device from a bottle neck, the catch member serves to lock on the device even harder. An appropriate security system label or other active or passive responder conveniently is attached to the device so that if an attempt is made to carry the bottle out of a store through suitable sensors, an alarm will be triggered—but in view of the highly visible presence of the device on a bottle neck, the probability of a thief attempting to carry such a bottle out of a store is greatly reduced.

In a preferred embodiment of this invention, the release means includes an operating member for the catch member and a magnetic locking element which is spring-urged to a normal position where the locking element restrains movement of the operating member. For such a case, the locking element may be moved against the action of the spring under the influence of an external magnetic field to an attracted position where the operating member is freed for movement and so may move the catch member to its free position. Then, a bottle neck may be withdrawn from the sleeve. For this purpose, the operating member preferably has an operating button which, when depressed, moves the operating member and so also moves the catch member to its free position.

In an alternative embodiment, the release means includes a magnetic operating member spring-urged to a normal position and movable against the action of the spring under the influence of an external magnetic field, to an attracted position. The operating member is linked to the catch member for example by means of a peg on the catch member engaged in an opening in the operating member, such that movement of the operating member also moves the catch member between its locking and free positions.

Conveniently, the operating member is slidably mounted within the housing for movement generally in a radial direction, with respect to the bore of the sleeve. In this case, the spring may urge the operating member towards the bore in the sleeve, and the applied magnetic field moves the operating member away from the bore so releasing the catch member.

In yet another embodiment, the catch member carries a magnetic armature whereby the catch member is directly moved under the influence of an external magnetic field to its free position. Such an arrangement is significantly simpler than those embodiments described above, in that no separate locking member nor operating member need be provided. Further, in a case where there is a plurality of catch members arranged parallel to one another, each may operate independently of the others, so enhancing security in use.

Preferably, in all of the above embodiments of this invention the catch member is pivotally mounted on the sleeve for movement between its locking and free positions. These positions may be defined by the aperture through the wall of the sleeve through which the inner portion of the catch member extends, the aperture having two opposed edges and the catch member engaging either one or the other edge, at its two positions respectively. A spring may be arranged to move the catch member to its locking position, which spring may be formed integrally with the catch member for engagement with a fixed part of the sleeve.

The housing serves to prevent unauthorised access to the catch member and the release mechanism. To this end, the housing may have a first part integral with the sleeve and on which the catch member is mounted, and a second part which is engageable with the first part and when engaged therewith serves to enclose the release mechanism and the part of the catch member external of the sleeve. Conveniently, both the sleeve and the housing parts are moulded from a plastics material and the two parts of the housing are bonded together or otherwise snap-fit together, so as thereafter to resist separation.

Greater versatility may be achieved by having at least two, or possibly more, essentially similar catch members arranged with their pivotal axes parallel and one catch member above the other. For some bottles both or all of the catch members may engage a suitable shoulder on a bottle neck or cap so giving greater security of attachment, though for other bottles only one of the catch members might engage a shoulder on the neck or cap, depending upon the configuration of the bottle neck.

BRIEF DESCRIPTION OF THE DRAWINGS

By way of example only, three specific embodiments of bottle security device of this invention will now be described in detail, reference being made to the accompanying drawings, in which:

FIG. 1 is a general perspective view of the first embodiment of security device, when fully assembled;

FIG. 2 is an axial section through the device of FIG. 1;

FIG. 3 is a transverse section through the device;

DETAILED DESCRIPTION OF THE INVENTION

Figure 4:
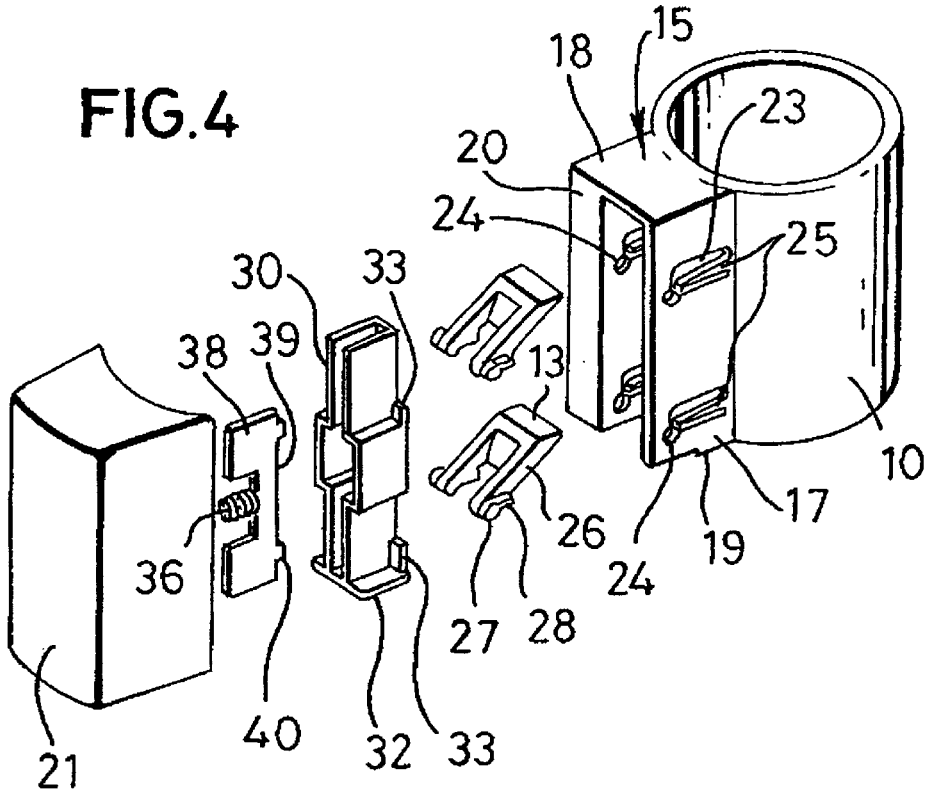
FIG. 4 is an exploded view of the various components making up the device, from a first point of view.
Figure 5:
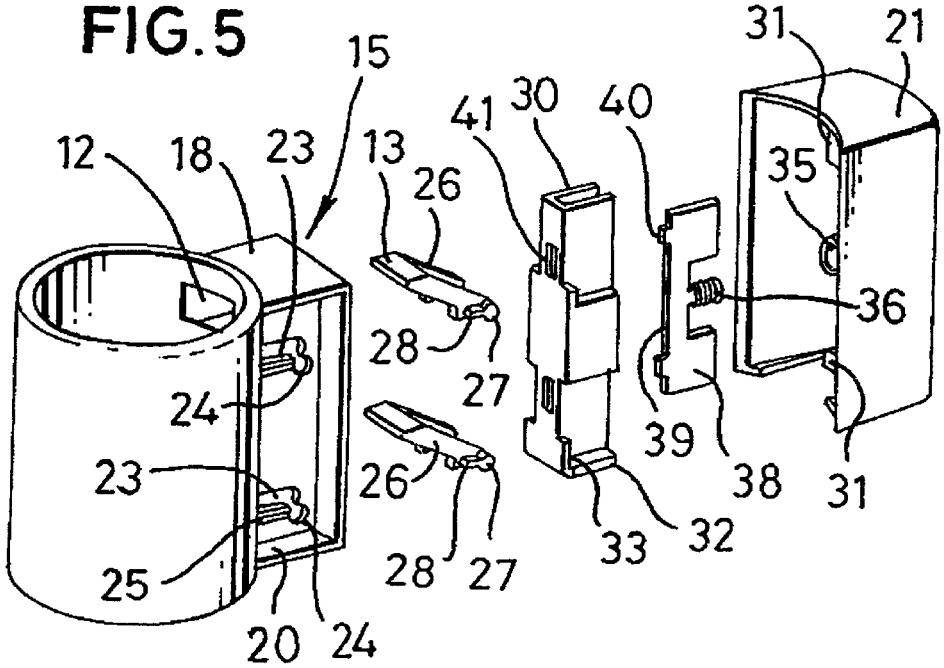
FIG. 5 is a further exploded view, but from a second point of view.

Referring initially to FIG. 1, it can be seen that the device comprises a sleeve 10 having a housing 11 projecting laterally from the sleeve, for essentially the full length of the sleeve. A pair of catch members (only a part of one of which is visible in FIG. 1) is mounted within the housing and each catch member projects through a respective aperture 12 so that an inner portion 13 of the catch member projects into the bore of the sleeve.

The lower end of the sleeve is flared as shown in FIG. 2, and is configured so that the internal diameter of the sleeve will fit over the majority of alcoholic drink bottles widely available in shops, supermarkets, liquor stores and so on. Moreover, the length of the sleeve and the positions of the two apertures 12 having the respective catch members are chosen so that at least the majority of a wide range of bottle necks may extend within the sleeve to permit the device to be locked thereto; some bottle necks will be too short to project right through the sleeve, whereas others may project beyond the end of the sleeve. Typically, the axial length of the sleeve might be in the range of 30 mm to 60 mm and in one preferred embodiment is 47 mm.

The housing 11 is formed by a first housing part 15 formed integrally with the sleeve 10 and having a pair of parallel spaced-apart walls 16, 17 and a bridging wall 18 extending between the upper ends of the walls 16, 17. A shorter bridging wall 19 is provided between the lower ends of the walls 16, 17. Wall 16 has outwardly-projecting flanges 20, for a purpose to be described below. A second housing part 21 fits over the first housing part 15 so as wholly to enclose that part 15 except for the lower end thereof; the second housing part 21 is thus channel-shaped, and is closed at its upper end. The second housing part may be secured to the first housing part and also the sleeve by means of an adhesive, welding, or may include nibs or ribs (not shown) inter-engageable with recesses or grooves (also not shown) formed on the first housing part, to resist the removal of the second part, once fitted to the first part.

A chamber is formed between wall 16 and the adjacent wall of the second housing part 21, defined by flanges 20. A responder (shown in outline at 22) for a security alarm system is located in that chamber, which responder typically might be a passive electromagnetic strip device of a kind well known in the art. Alternative devices could include an active responder, an RF responder or an acoustic strip, depending upon the security system being employed in the store where the bottle security device is to be used. Instead of utilising the chamber 22 for holding the security responder, especially in the case of an RF passive responder, the responder may be fitted into a container in the form of a cap for the sleeve and permanently attached thereto. In this case, it may be necessary to make the sleeve longer, since the free end of the bottle neck and its cap no longer may project through the sleeve.

Each side wall 16, 17 of the first housing part has a pair of slots 23 formed therethrough, with each slot on one side wall in alignment with the corresponding slot on the other wall. Each slot is generally elongate and has an extension 24 of circular cross-section formed at its end remote from the sleeve 10. Formed integrally with the respective wall is a spring blade 25, projecting within the slot towards the extension 24, though a separate spring could instead be employed. A pair of catch members 26 are mounted between the walls 16, 17, each catch member having a pair of projections 27 of circular shape and receivable in the opposed extensions 24 of the slots 23, each projection also having a lug 28 which engages under the respective spring blade 25. When so positioned, the length of each catch member is such that its inner portion 13 projects through the respective aperture 12 in the sleeve, as shown in FIG. 2. Each spring blade acts on the respective catch lug 28 to urge the catch members to the positions shown in FIG. 2 but the catch members may be moved in a counter-clockwise sense (in FIG. 2) against the action of the spring blades until the catch members engage the upper edges of the respective apertures 12 and the inner portions 13 of the catch members no longer project into the bore of the sleeve 10.

An operating member 30 is slidably mounted between the walls 16, 17 and locates on a pair of guides 31 formed internally on the second housing part 21. The operating member 30 includes an operating button 32 which projects out of the lower end of the housing and has catch-operating abutments 33 which engage the lower surfaces of the catch members 26, adjacent the projections 27. The button is thus urged by the catch members to the position shown in FIG. 2 but may be pressed into the housing so lifting the catches against the action of the spring blades 25. Alternatively, or in addition, a separate spring may be arranged to urge the operating member to the position shown in FIG. 2.

A cylindrical boss 35 projects inwardly of the second housing part, between the guides 31. A helical spring 36 is positioned within that boss and locates on a central leg provided on an iron armature 38 received between the side faces of the operating member 30, and slideable between the guides 31 of the second housing part. The edge 39 of the armature 38 facing sleeve 10 has a pair of locking projections 40 which are normally received in openings 41 formed in the operating member 30. Thus, when fully assembled, those projections 40 serve to prevent movement of the operating member 30 and so prevent pressure applied to the button 32 moving the catch members to their respective positions where their inner ends 13 do not project into the bore of sleeve 10. On positioning the device within a sufficiently strong magnetic field, the armature 38 is moved against the action of spring 36 so lifting the projections 40 out of the openings 41 in the operating member, whereafter depression of the button 32 moves the catch members.

The normal position of the various components of the device is shown in FIG. 2. As such, the device may be slid over the neck of a bottle, with the inner portions 13 of the catch members 26 lifting as necessary to give sufficient clearance for the bottle cap, shoulders on the neck and so on to enter the sleeve. Subsequently, should an attempt be made to pull the device off a bottle neck, the catch members will be moved downwardly more tightly to engage the bottle neck and more securely to hold the device to that neck. When the device is to be removed, for example on the sale of the bottle, the housing is simply positioned closely adjacent a permanent magnet of a sufficient strength so as to move the armature against its spring bias and permit depression of the operating button 32. This lifts the catch members 26 to permit the removal of the device from the bottle neck.

Figure 6:
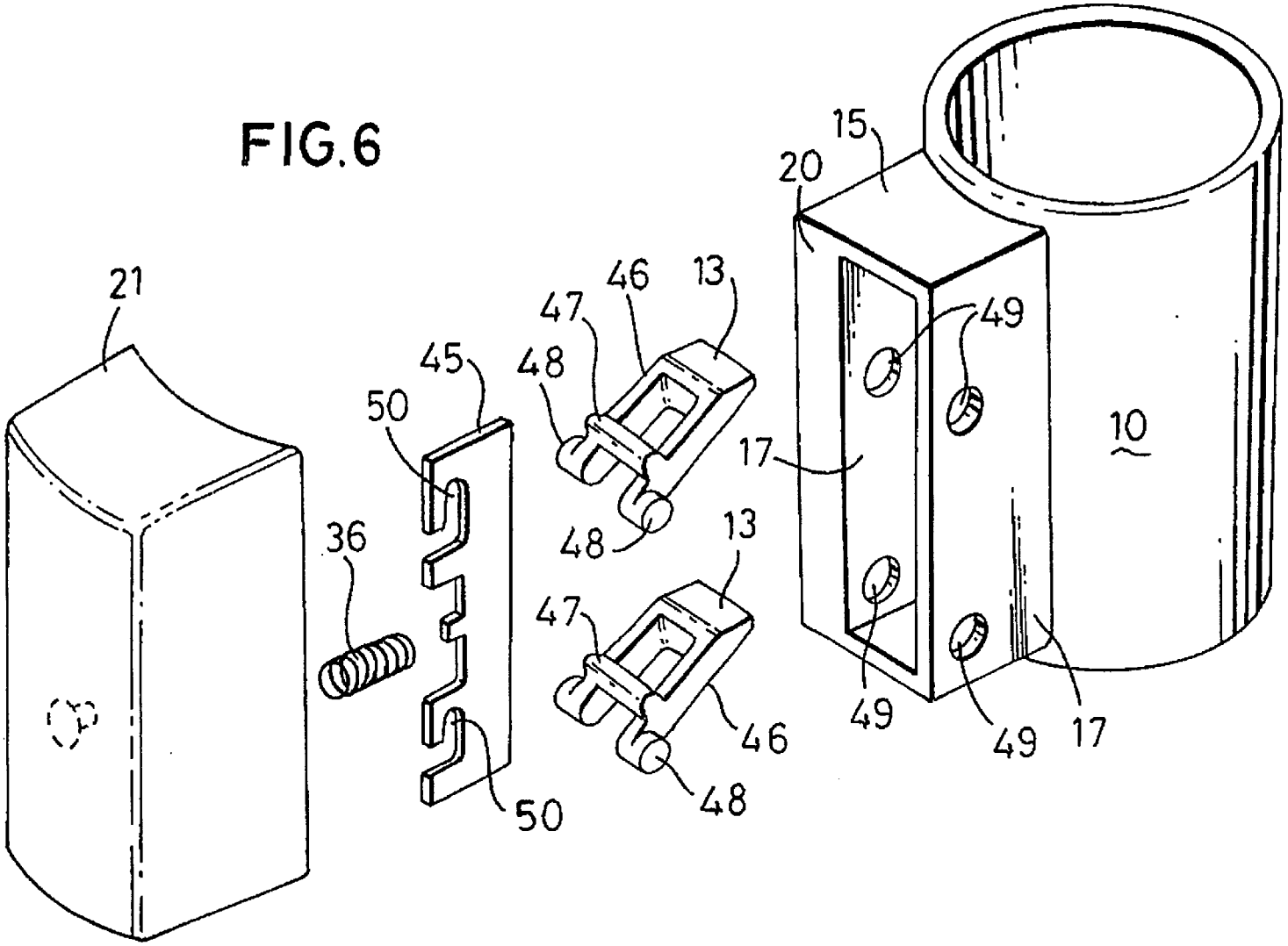
FIG. 6 is an exploded view of a second embodiment of bottle security device.

Referring now to FIG. 6, there is shown a second embodiment which, though generally similar to that described above, employs a different design of releasing mechanism for the catch members 26. Insofar as is applicable, the same reference characters are used to identify the same or similar components as those of FIGS. 1 to 5.

In the embodiment of FIG. 6, there is a latch plate 45 slidably mounted within the second housing part 21, the latch plate being urged by spring 36 towards the bore of the sleeve 10. The latch plate 45 is of soft iron and serves as an armature for an applied external magnetic field, such that the latch plate 45 may be pulled to the left (in the drawings) against the action of spring 36, when the device is offered to a strong magnetic field.

The two catch members 46 are generally similar to the catch members 26 except that each member has a cross-bar 47 extending between the catch side arms, the lower ends of which arms are provided with simple cylindrical projections 48 received in corresponding holes 49 formed in the side walls 17 of the first housing part 15. The catch members 46 are simply snapped in position so that the projections 48 locate in the holes 49 whereby the catch members may then pivot about the axes of the respective holes 49.

The latch plate 45 has two L-shaped slots 50 disposed so that the crossbars 47 may locate one in each slot respectively. Then, movement of the latch plate 45 to the left, under the influence of an applied magnetic field, will cause the catch members 46 to pivot in a counter-clockwise sense (in the drawings) so lifting the inner ends 13 of the catch members.

A third embodiment of this invention is shown in FIGS. 7 and 8, and again like parts with those of the previous embodiments are given like reference characters. In this embodiment, there are three similar catch members 55 each arranged for pivoting movement with respect to the sleeve 10. Each catch member 55 is moulded from a plastics material and has an integrally-formed spring blade 56 which, in use, engages a corresponding projection 57 formed on the second housing part 21, to urge the catch member in the clockwise sense (in FIG. 7).

Figure 7:
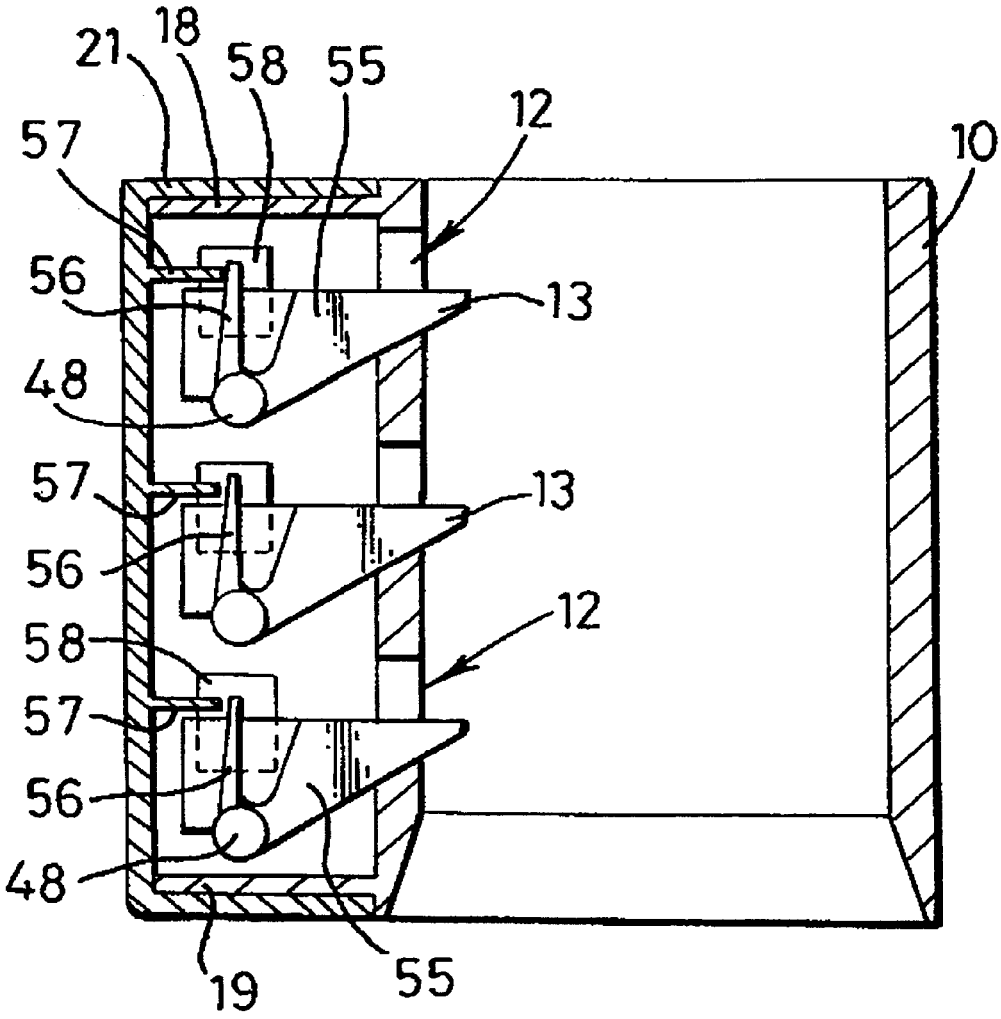
FIGS. 7 and 8 correspond generally to FIGS. 2 and 4, but showing a third embodiment of bottle security device.

Each catch member 55 further defines a socket in which is located a soft iron slug 58, for attraction by an external magnet to cause the catch member to pivot in a counter-clockwise sense, so moving the catch member away from its locking position shown in FIG. 7 to its free position, where the sleeve may be removed from a bottle neck. For this purpose, there may be provided a magnet assembly having three poles suitably disposed simultaneously to attract the three slugs respectively.

As compared to the previous embodiments, this third embodiment has fewer parts and also the advantage that the movement of any one of the three catch members is wholly independent of the others. This will give greater security in use.

Figure 8:
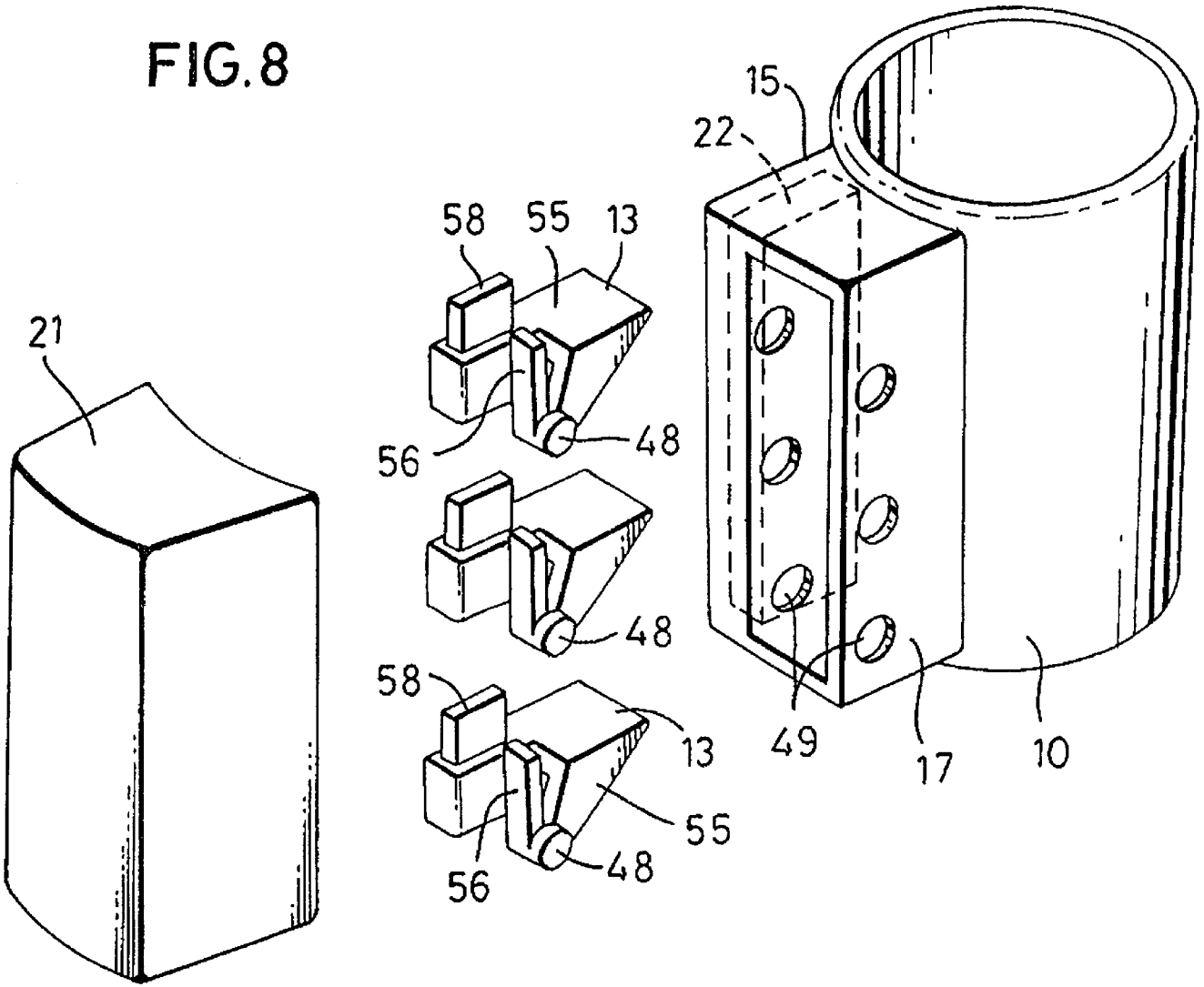

In other respects, the embodiments of FIG. 6 and FIGS. 7 and 8 are used and operate in essentially the same manner as that of the embodiment of FIGS. 1 to 5 and so will not be described in further detail here.

What is claimed is:

1. A security device for a bottle having a neck fitted with a closure, the security device comprising:

a sleeve adapted to fit over the neck of the bottle and having an aperture formed therethrough;

a catch member pivoted to the sleeve externally of the bore for movement between free and locking positions, the catch member having an inner portion which projects through the aperture in the sleeve into the bore thereof and which inner portion is adapted to engage a shoulder of a bottle neck or the closure thereby to resist removal of the sleeve from the bottle neck when the device has been pressed thereon and the catch member is in its locking position;

spring means urging the catch member to its locking position;

magnetically-operable release means operatively associated with the catch member to control movement thereof away from its locking position to its free position, the magnetically-operable release means including a magnetic locking element which is attracted away from a normal position by an external magnetic field thereafter permitting pivoting movement of the catch member; and a housing enclosing the release means and that part of the catch member external of the sleeve to prevent manual access thereto.

2. A security device as claimed in claim 1, wherein the release means includes an operating member for the catch member and the magnetic locking element is spring-urged to its normal position where the locking element restrains movement of the operating member to a position where the catch member may move to its free position.

3. A security device as claimed in claim 2, wherein a spring biases the locking element to its normal position, and the locking element is movable against the action of the spring under the influence of the external magnetic field to an attracted position where the operating member permits movement of the catch member to its free position, whereafter the sleeve can be removed from a bottle neck.

4. A security device as claimed in claim 3, wherein the operating member has an externally-accessible portion which may be depressed to move the catch to its free position when the locking element has been moved to its attracted position.

5. A security device as claimed in claim 4, wherein said externally-accessible portion of the latch comprises a button projecting through an opening in the housing.

6. A security device as claimed in claim 1, wherein the release means includes a magnetic operating member spring-urged to a normal position and movable against the action of the spring under the influence of an external magnetic field to an attracted position, the operating member being linked to the catch member so as to move the catch member between its locking and free positions corresponding to the operating member being moved between its normal and attracted positions.

7. A security device as claimed in claim 6, wherein the operating member is mounted for sliding movement within the housing in a generally radial direction with respect to the bore.

8. A security device as claimed in claim 7, wherein the operating member is in the form of an iron plate having an opening therethrough, the catch member having a peg engaged in the aperture.

9. A security device as claimed in claim 1, wherein the catch member carries a magnetic armature whereby the catch member is directly moved under the influence of an external magnetic field to its free position.

10. A security device as claimed in claim 9, wherein the locking and free positions of the catch member are defined by the aperture in the sleeve through which said inner portion of the catch member extends, by the catch member engaging one or another opposed edge of the aperture.

11. A security device as claimed in claim 10, wherein the catch member is free to move to its free position as the sleeve is pressed on to a bottle neck but on attempting to pull the sleeve off a bottle neck the catch member moves to its locking position so as thereafter to restrain the device on the bottle neck.

12. A security device as claimed in claim 1, wherein the housing has a first part integral with but externally of the sleeve, the catch member being pivoted on said first part for movement between its free and locking positions, and the housing has a second part engageable with the first part to enclose the release means and the part of the catch member external of the sleeve.

13. A security device as claimed in claim 12, wherein the first housing part has a pair of parallel spaced-apart flanges lying in planes parallel to the sleeve axis, the catch member being supported between and by the flanges.

14. A security device as claimed in claim 1, wherein the sleeve is open-ended so that it may be pressed sufficiently far on to a relatively long bottle neck for the end of that bottle neck to project beyond the sleeve.

15. A security device as claimed in claim 1, wherein there is at least one further catch member pivoted to the sleeve externally of the bore and having an inner portion which projects into the bore of the sleeve, said at least one further catch member being simultaneously movable with the first-mentioned catch member to their respective free positions upon operation of the release means.

16. A security device as claimed in claim 15, wherein the configuration of the second catch member and the operation thereof is essentially the same as that of the first-mentioned catch member.

17. A security device as claimed in claim 1, wherein the device is furnished with an active or passive security responder, to trigger an alarm system if moved out of a protected area.

18. A security device as claimed in claim 6, wherein there is at least one further catch member pivoted to the sleeve externally of the bore and having an inner portion which projects into the bore of the sleeve, said at least one further catch member being simultaneously movable with the first-mentioned catch member to their respective free positions upon operation of the release means.

19. A security device for a bottle having a neck fitted with a closure, which security device comprises a sleeve adapted to fit over the neck of the bottle and having an aperture formed therethrough, a catch member pivoted to the sleeve externally of the bore for movement between free and locking positions, the catch member having an inner portion which projects through the aperture in the sleeve into the bore thereof and which inner portion is adapted to engage a shoulder of a bottle neck or the closure thereby to resist removal of the sleeve from the bottle neck when the device has been pressed thereon and the catch member is in its locking position, spring means urging the catch member to its locking position, magnetically-operable release means operatively associated with the catch member to control movement thereof away from its locking position to its free position which magnetically-operable release means includes a magnetic locking element which is attracted away from a normal position by an external magnetic field thereafter permitting pivoting movement of the catch member, and a housing enclosing the release means and that part of the catch member external of the sleeve, the housing having a first part integral with but externally of the sleeve, the catch member being pivoted on said first part for movement between its free and locking positions, and a second part engageable with the first part to enclose the release means and the part of the catch member external of the sleeve to prevent manual access thereto.

20. A security device as claimed in claim 19, wherein the first housing part has a pair of parallel spaced-apart flanges lying in planes parallel to the sleeve axis, the catch member being supported between and by the flanges.

* * * * *